US006279327B1

(12) United States Patent
zu Königsegg

(10) Patent No.: US 6,279,327 B1
(45) Date of Patent: Aug. 28, 2001

(54) FLUSHING APPARATUS FOR DRINKING VESSELS

(75) Inventor: Frederic Graf zu Königsegg, Kloten (CH)

(73) Assignee: Gregor vom Rintelen (DE)

( * ) Notice: Subject to any disclaimer, the term of this patent is extended or adjusted under 35 U.S.C. 154(b) by 0 days.

(21) Appl. No.: 09/401,157

(22) Filed: Sep. 20, 1999

(30) Foreign Application Priority Data

Sep. 18, 1998 (DE) ..... 298 16 798 U

(51) Int. Cl.[7] ..... F25D 25/00
(52) U.S. Cl. ..... 62/62
(58) Field of Search ..... 62/52.1, 62, 64, 62/373

(56) References Cited

U.S. PATENT DOCUMENTS 2,470,228 * 5/1949 Aksomitas ..... 49/45
2,470,245 * 5/1949 Green ..... 49/89
3,602,008 * 8/1971 Kelley ..... 62/373
5,406,803 * 4/1995 Casto, II ..... 62/52.1

* cited by examiner

*Primary Examiner*—William Doerrler
*Assistant Examiner*—Malik N. Drake

(57) ABSTRACT

A flushing apparatus for drinking vessels and/or for vessels suitable for the storage of liquid, in particular for glasses, is described, and provides a space to receive at least one drinking vessel and/or at least one vessel suitable for the storage of liquid and includes a duct system, with which a cryotechnical medium can be supplied directly into the space for receiving drinking vessels. It is thus possible for the first time to cool drinking vessels down to a desired temperature, substantially independently of the predetermined drinking vessel temperature, in a very short time, and thus to insure the cooling, remaining uniform for a long period, of a drink which is subsequently poured in.

16 Claims, 4 Drawing Sheets

FLUSHING APPARATUS FOR DRINKING VESSELS

The invention relates to a flushing apparatus for drinking vessels and/or for vessels suitable for the storage of liquid, and in particular for glasses, the dais apparatus having a space to receive at least one drinking vessel.

It is frequently required to have drinks which are cooled or are at the right temperature. In order to keep the drink cooled for as long as possible after it has been poured into a drinking vessel, substantially three methods have been used up to now, both privately and in businesses, particularly in gastronomy.

On the one hand, there is the possibly of keeping the drinks cold by the use of ice cubes. However this often has the disadvantage that the drink becomes watered down when the ice cube melts, and there is a negative effect on the desired, i.e., original taste of the drink. The warmer the glass already was at the time the drink was poured in, the faster the melting of the ice cube takes place. Such a case often occurs, for example, in gastronomic businesses when a large throughput of glasses takes place during rush hours or high volume business, and glasses which have been rinsed or cleaned with warm or hot water have to be again filled with drinks and put to use afresh while still in the warmed state.

On the other hand, the possibility exists of storing the drinking vessels in refrigeration for a given time before re-using them. This admittedly prevents the pre-cooled glasses giving up their own heat to the drink; however, the cooling process itself is particularly time-consuming and, in the case of a high throughput of required glasses as already mentioned, can be carried out only to a limited extent. Furthermore, normal refrigerators or conventional cooling devices have a tendency to become contaminated.

A further possibility consists of using closed ice cube bags or containers for cooling the drink. Thus a watering-down of the drink when the ice melts is admittedly prevented by means of the enclosed ice cubes. Particularly in gastronomic establishments, however, when such ice cube bags are used, a reliable and thus very intensive cleaning of the bag after use is required, not least because of health regulations, in order to remove or kill substantially all germs from the bag before it is re-used.

The invention consequently has as its object to insure the cooling of drinks in the most simple manner, with a saving of cost and time, while avoiding the problems mentioned hereinabove. It would also be of the greatest advantage to efficiently attain a drink temperature which remains constant and is effectively maintained for as long a time as possible.

The object is attained in a surprisingly simple manner by a flushing apparatus for drinking vessels with the features of claim 1.

If drinking vessels are flushed with a flushing apparatus according to the invention, which provides space to receive at least one drinking vessel and/or at least one vessel suitable for the storage of liquid, and which includes a duct system with which a cryotechnical medium can be conducted directly into the space for receiving drinking vessels, it is possible for the first time to cool drinking vessels down to a desired temperature in a very short time, substantially independently of the present drinking vessel temperature, and thus to insure a long-lasting cooling, which remains constant, for a drink which is subsequently poured in.

The glasses which are shock-cooled in this manner advantageously no longer give up their own heat to the drink, and a watering down such as is the consequence of cooling with ice cubes is effectively prevented. A further advantage is that by the saving of the refrigerators heretofore required for the time-consuming cooling of glasses, a substantial reduction can otherwise be attained, for example, due to the costs for the consumption of current.

In practice, the technical gases nitrogen and carbon dioxide have been found to be suitable media for the cryotechnical applications according to the invention. Among other things, this is because these gases are colorless, odorless, and tasteless. According to the field of use of the flushing apparatus according to the invention and therefore relating to the present ambient conditions, particularly relating to the provision of the pressure and the temperature, it is provided to make possible the supply of the cryotechnical media in a gaseous or liquefied state.

If the flushing apparatus according to the invention advantageously includes a control device, preferably with at least one operating device, a defined control of the pressure, the intensity, and/or the temperature of the medium to be supplied can be insured, according to the kind of glass to be flushed with the cryotechnical medium. Cooling free from damage can hereby always be insured during the flushing process in dependence on the different thermal expansion coefficients of different drinking vessels or kinds of glass.

In order further to increase the gentleness of the action on the drinking vessel and/or vessel suitable for storing liquid, it is appropriately provided to constitute nozzle-like outlet openings of the supply system reaching into the receiving space, in order to obtain as uniform cooling as possible of the whole drinking vessel.

In a particularly preferred development, it is provided to constitute the receiving space in a shape of a cylinder, open upward, in particular in the form of a cup with therein a coaxially aligned guide element for the drinking vessel, and to arrange radially aligned outlet nozzles on the inner wall of the cylinder and/or on the guide element, in order to insure a controlled outflow of the cryotechnical medium, uniformly distributed over the drinking vessel.

A release device which is connected to the duct supply with the use of a valve is appropriately associated with the guide element arranged in the interior, and releases the flushing process, and thus the supply of the cryotechnical medium, upon a predefinable pressure being exceeded which can be produced by putting a drinking vessel in place over the guide element.

In an alternative, equally preferred embodiment of the invention, it is provided, for the receipt of drinking vessels which are preferably arranged in a loadable rack, to arrange a completely closable space with inward-directed outlet nozzles of the duct system supplying the cryotechnical medium on the inner walls, the cover, and/or the floor. In practice, the use has been found appropriate here of at least one propeller-like rotary body on which outlet nozzles are arranged.

In a further advantageous development of the invention, it is provided that the flushing apparatus according to the invention for the cooling of drinking vessels is provided with a further supply system for the supply of water. In this way it is possible to carry out both a cleaning rinse with water and also the flushing with the cryotechnical medium, in one and the same flushing apparatus. For this purpose, the flushing apparatus appropriately has a changeover device with which a predefined activation of the water supply system can be controlled. Thus, for example, a water rinsing process can be advantageously operated before, or even in parallel with, the flushing process with the cryotechnical medium.

Another embodiment of the flushing apparatus according to the invention contains a water supply system which can be associated with the inner wall of the receiving body, the guide element, and/or a further, rod-shaped or coil-shaped, guide element provided with at least one outlet opening.

Further developments of the flushing apparatus according to the invention are preferred in which the water supply system and the duct system for the supply of the cryotechnical medium have a region of contact so that water supplied during a flushing process can already be cooled by means of the duct system for the supply of the cryotechnical medium and/or directly by means of the cryotechnical medium.

The invention will be described in more detail hereinbelow with respect to two preferred embodiments, with reference to the accompanying drawings.

Figure 1:
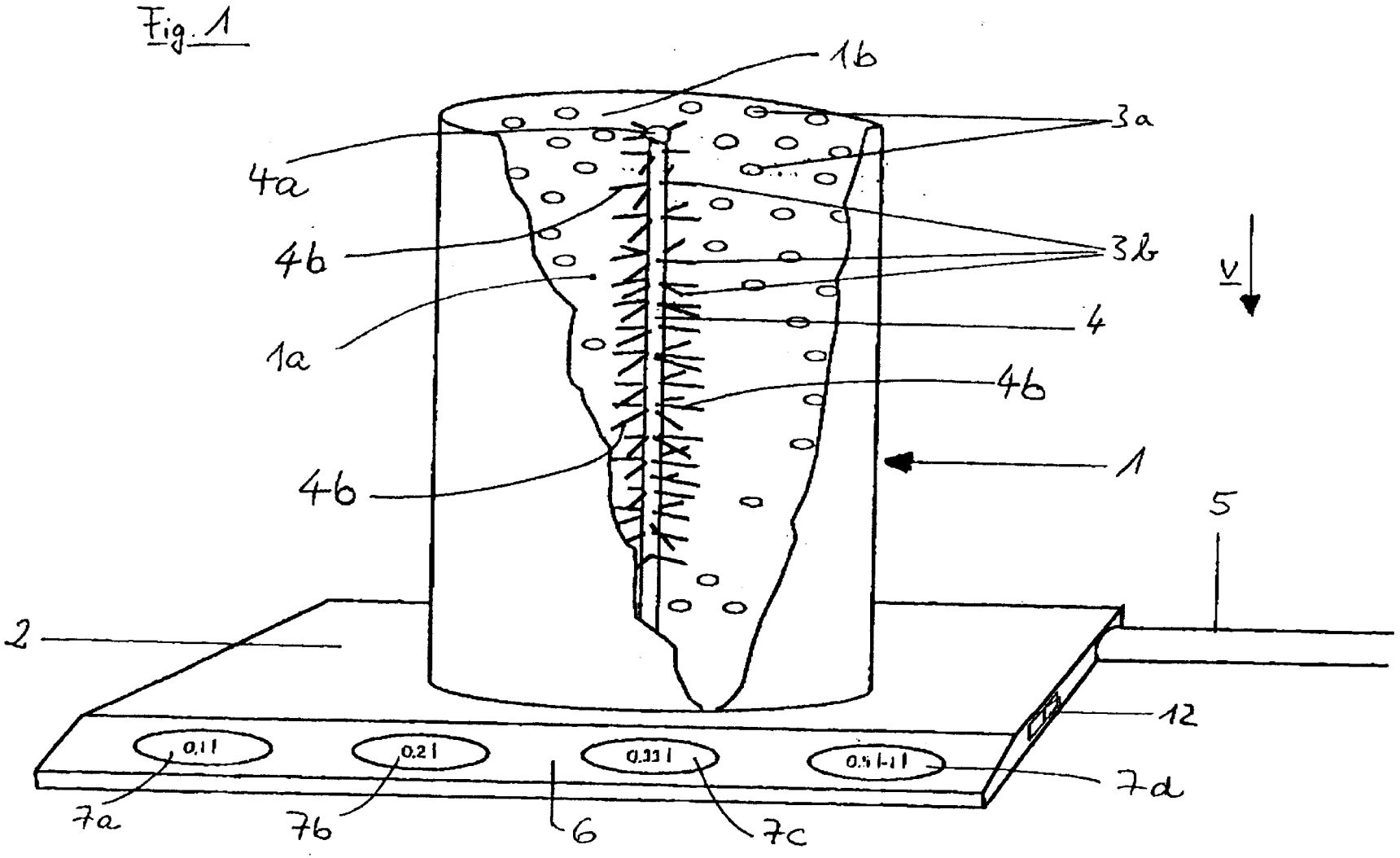
FIG. 1 shows a view, partially broken away, of a first embodiment of the flushing apparatus according to the invention, with a cylindrical receiving space.

FIG. 1 will first be referred to hereinbelow; it shows by way of example a sketch of a flushing apparatus according to the invention, partially broken away, with a cup-like receiving member 1, open upward and arranged on a baseplate 2.

The cup 1 preferably has outlet nozzles 3*a,* indicated sketchily and not to scale, arranged on an inner wall 1*b* of its envelope, and also a guide element 4, for a drinking vessel to be flushed, arranged substantially centrally in a cavity 1*a* which is surrounded by the cup 1. Radially directed, needle-like, hollow rods 4*b* are installed on the guide element 4. Outlet openings 3*b* are then installed, preferably at the ends of the rods 4*b,* so that the guide element substantially has the form of a nozzle tree. The longitudinal axis of the nozzle tree 4 then runs substantially parallel to the longitudinal axis of the cup 1. The rods 4*b* are preferably of equal length, but in a particularly preferred embodiment can also have differing lengths, and the rods 4*b* can be installed so that their length decreases along the longitudinal axis of the guide element 4 from an end of the guide element 4 facing the baseplate 2. The guide element of this particularly preferred embodiment, provided with rods 4*b* in this manner, somewhat resembles a fir or spruce tree in shape.

The outlet openings 3*b* can preferably also be provided on the envelope surfaces of the preferably cylindrical rods. The outlet nozzles 3*a* and 3*b* are connected by a duct system, not shown in detail, and via a supply connection duct 5 to a container containing a cryotechnical medium, in the present example a carbon dioxide cylinder. The outlet nozzles 3*a,* 3*b* insure a controlled outflow of the gas, in order that damage to the drinking vessels is as a rule excluded.

The outlet openings 3*a,* 3*b* are according to the invention connected in common to a duct system. However each of the outlet openings 3*a,* 3*b* can preferably be connected to its own supply duct, which has a connection to a source of the cryotechnical gas.

The nozzle tree 4 of the present embodiment example is of substantially hollow form and is thus used as a portion of the duct system for the outlet nozzles 3*b* arranged on the nozzle tree. The outlet nozzles arranged on the inner wall 1*b* of the cup envelope are for example connected to the duct system by the use of flexible tubes which run along an outer wall of the cup. The possibility also exists of making the cup 1 double-walled, with an interspace for the accommodation of a portion of the supply of media, and to perforate the inner wall and/or to provide it with nozzles.

It should be pointed out that the arrangement, both of the outlet nozzles 3*a* on the inner wall 1*b* of the cup envelope, and also of the outlet nozzles 3*b* installed on the nozzle tree, is freely selectable, and also the nozzle tree can be constituted very differently, according to requirements. It should furthermore be mentioned that the number and also the size of outlet openings can be very different according to specific applications; thus, for example, a large, centrally arranged nozzle outlet can already be sufficient.

An upper section 4*a,* preferably plate-shaped, of the nozzle tree 4 used in the embodiment example is spring-mounted in a known manner, and when a pressing force is exerted in the direction of the arrow v, opens a valve associated with the duct system, whereupon the carbon dioxide, when a pressure cylinder is connected, reaches the outlet nozzles 3*a* and 3*b* and emerges therefrom into the cavity surrounded by the cup 1.

For the cooling flushing with carbon dioxide of a drinking vessel or a vessel suitable for storing liquid, this vessel is put upside down onto the head of the nozzle tree 4, the nozzle tree 4 then ensuring the sure and defined guiding of the drinking vessel during the flushing process. The flushing process proper for the cooling of the drinking vessel is initiated when pressure is exerted in the direction of the arrow v with the bottom of the drinking vessel placed upside down on the nozzle tree.

By the use of the cryotechnical gas, the cooling of a glass by the use of the flushing apparatus according to the invention is reduced to a short period of about a second.

In order further to exclude damage of the glass to be flushed, particularly when different glass vessels or drinking vessels are to be flushed, a unit which controls the gas supply system is mounted in the baseplate 2, and is operated with an associated operating unit 6, which in the present example has four press buttons 7*a*–7*d.*

As can be seen in FIG. 1, units of measure such as for example "0.11", "0.21", "0.31", and "0.51–11" are placed on the press buttons 7*a*–7*d.* The units of measure thus indicate that the outflow of the gas from the outlet openings 3*a,* 3*b* is to be respectively differently metered for different sizes of glasses or types of glasses and/or sizes of bottles, such as, for example, a "champagne glass", a "wineglass", a "beer glass", and/or a "water bottle", a "juice bottle", or a "beer bottle". Thus the pressure of the outflowing gas and its flow parameters can be preset for the individual type of vessel or for the individual size of glass, via the control unit by means of the press buttons 7*a*–7*d,* in order to be able to react to the different thermal expansion coefficients of different types of vessels with the degree of shock cooling brought about by the outflowing gas. It has been found that a substantially completely damage-free cooling process can be carried out in this manner in a very short time.

The exemplary cup 1 according to the invention, with the function of the release mechanism, the control unit and if necessary the supply system, can furthermore be switched on or off as a whole by means of an on/off switch 12 arranged on the baseplate 2.

It is furthermore within the scope of the invention to connect the cup 1 shown in FIG. 1, preferably constituted as a hollow cylinder, to a water supply in addition to the previously described gas supply system, and to provide outlet nozzles for the outflow of water which correspond to the outlet nozzles 3*a* and 3*b* for the gas. It is furthermore provided to arrange outlet nozzles which are correspondingly constituted for the outflow both of gas and also of water. In practice, the outflow of water takes place before the outflow of gas, to carry out a cleaning rinse with water before the cooling gas flushing. However, it is furthermore provided to allow water to outflow in parallel with the gas outflow, so that a thin layer of ice can be attained on the drinking vessel.

Thus the pressure-sensitive release mechanism of the nozzle tree 4 arranged in the interior of the cup 1 can be made two-stage in a manner known to one skilled in the art. If only the outflow of water is insured on attaining the first stage, and the outflow of the cryotechnical medium is first released on stronger action of force by the vessel or glass placed upside down over the nozzle tree 4, the cleaning process of first rinsing the drinking vessel with water and, following thereafter, the cryotechnical flushing process for cooling the drinking vessel down, can be carried out in only one working step of short duration. Preferably such a working step can be carried out in a few seconds.

Because of a saving of time achieved in this manner, a high throughput can as a rule be constantly insured, even when there is a high demand for cooled drinks.

Figure 2:
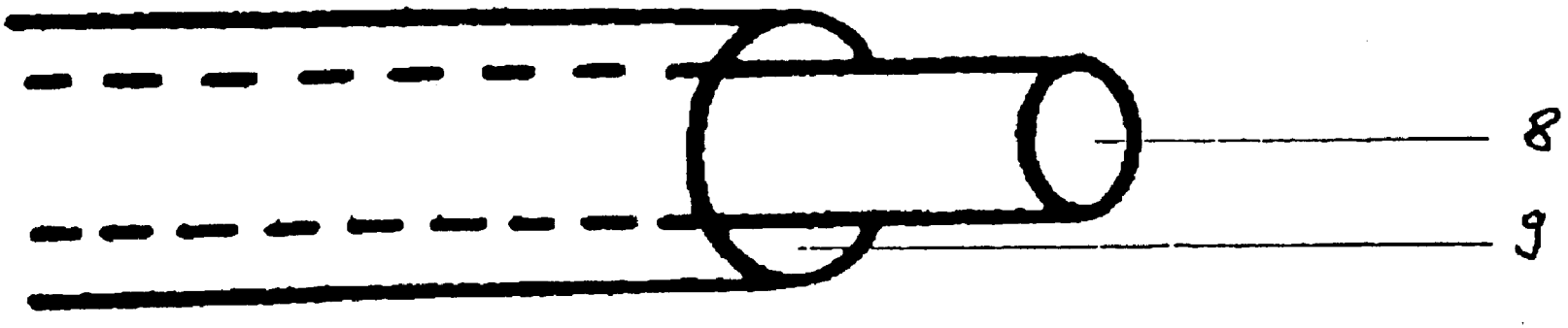
FIG. 2 shows a schematic illustration of an arrangement, by way of example, of a coaxial duct guide for the supply of the cryotechnical medium and of water.

In cases of application in which it is desired to cool drinking vessels already during the water rinse, the invention furthermore provides for arranging a supply system in which the gas-conducting ducts and/or flexible tubes 8 and water-conducting ducts and/or flexible tubes 8 have contact regions, so that a cooling of the water is already made possible there before its outflow to rinse the drinking vessel. Here the ducts and/or flexible tubes 8 or 9 conducting gas and water can be run bordering on each other or mutually adjacent, or can even be conducted coaxially as indicated for example in FIG. 2. Here, for a specific application, the inner duct can be the gas-conducting duct 8 or the gas-conducting flexible tube, which is surrounded by the water-conducting duct 9 or a water-conducting flexible tube. However, the water-conducting duct or the water-conducting flexible tube can be interior, surrounded by the gas-conducting duct 8.

As long as no freezing takes place at the corresponding temperatures, the gas can also be released in the water, so that the supply of water and gas takes place at least partially together in one duct. It should be mentioned in this regard, however, that in order to prevent a possible freezing up, a heating device associated with the duct system can be provided. Particularly suitable for this in practice is the use, known per se, of a thin heating wire which can be integrated in a simple manner into the duct system and/or can be arranged surrounding this partially at predefined places.

Figure 3:
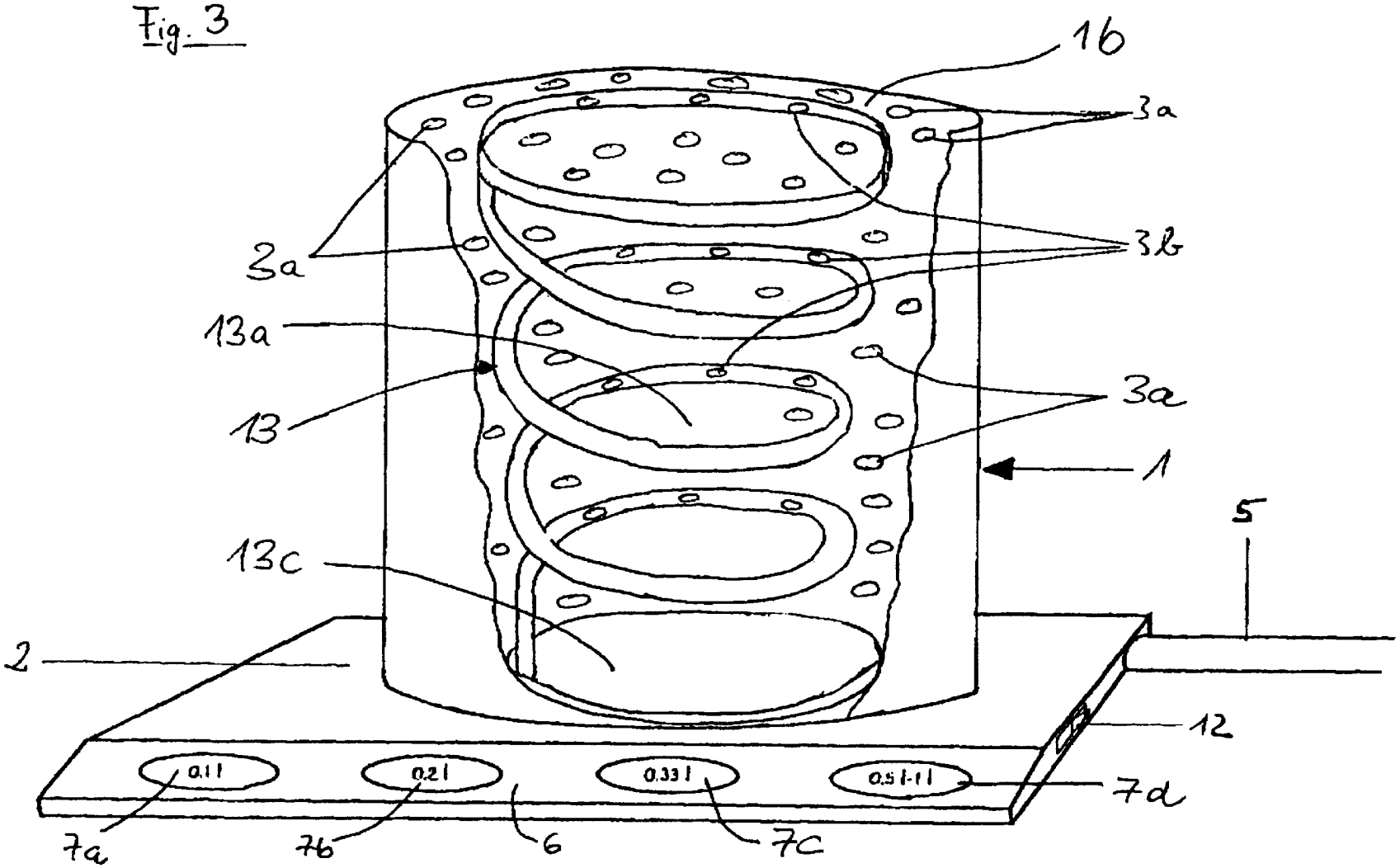
FIG. 3 shows a perspective view, partially broken away, of a further embodiment of the flushing apparatus according to the invention.

In a further embodiment of the invention, shown in FIG. 3, the guide element is preferably constituted as a coil 13. The longitudinal axis of the coil then preferably runs parallel to the longitudinal axis of the cup 1. The vessels are then placed in a space 13*a* surrounded by the coil. The vessels are preferably received by a receiving plate 13*c* installed on the coil 13. One or more outlet openings 3*b* are preferably situated on the inner sides of the helical coil, facing the space 13*a* surrounded by the coil. The outlet openings 3*b* correspond in function to those of the embodiment of FIG. 1. The supply leads and connections are likewise formed as described hereinabove. According to FIG. 3, in addition to the outlet nozzles 3*b* on the coil 13, outlet nozzles 3*a* can also be installed on the inner wall 1*b* of the cup envelope and can be connected to the corresponding supply ducts, in order to be supplied with a cryotechnical medium and/or water. The cryotechnical gas can outflow from the outlet openings 3*a* and/or 3*b* in the embodiment of the invention shown in FIG. 3, after an actuating device, preferably installed on the baseplate 2, is released.

Figure 4:
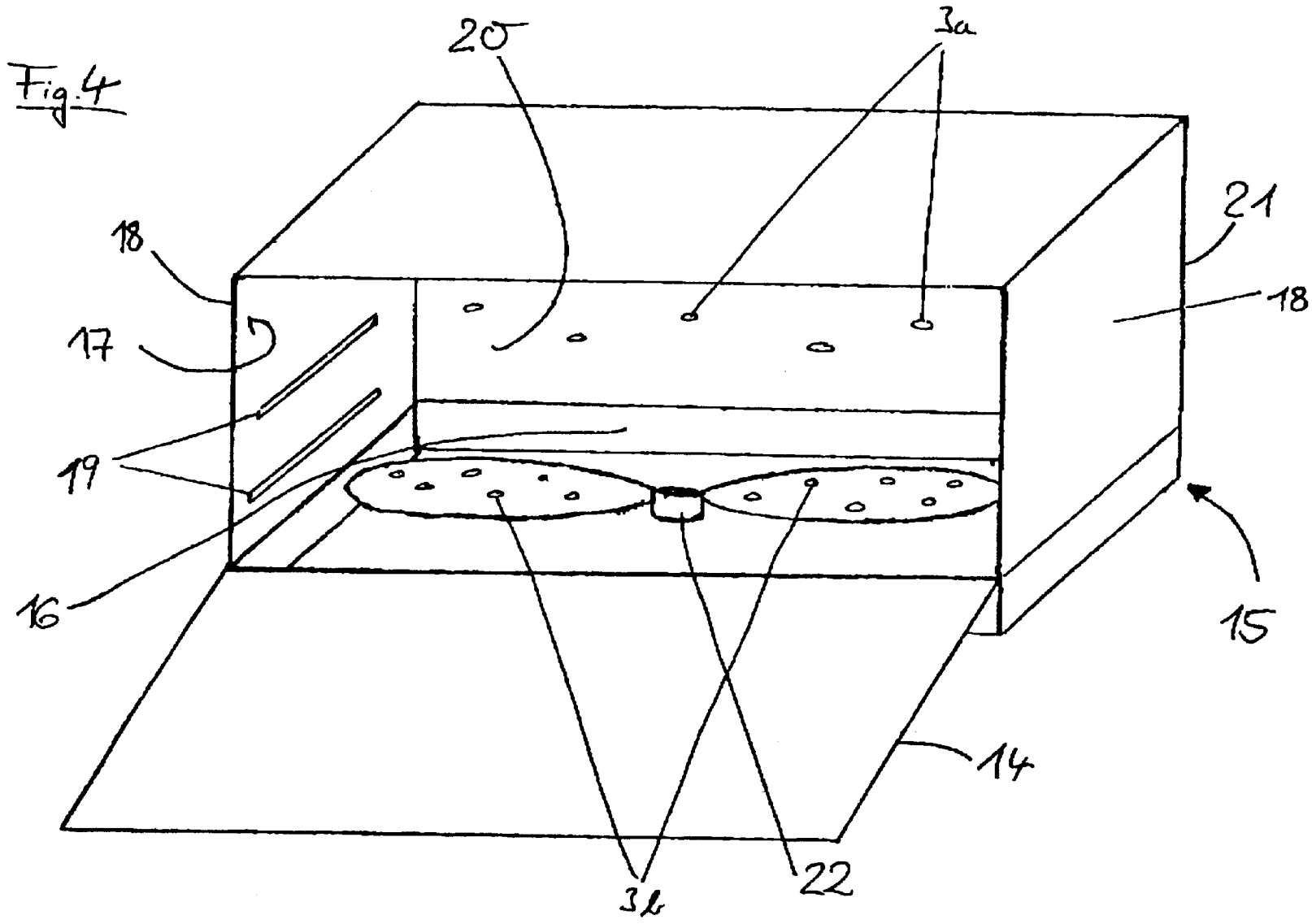
FIG. 4 is a schematic sketch showing the principle of a second embodiment according to the invention of the flushing apparatus, with a closable receiving space.

FIG. 4 sketches, by way of example, an embodiment of the flushing apparatus according to the invention, including, in contrast to the upward open flushing cup 1 shown in FIG. 1, a receiving body 15 which can preferably be gas-tightly closed, preferably with a flap 14, and which is constituted as a hollow body. In a preferred embodiment of the present invention, the receiving body 15 is of rectangular parallelepipedal shape. It may be mentioned that the like or functionally similar components of FIG. 4 and FIG. 1 are referenced with the same reference numbers.

Rail-like struts 19 are provided on the inner sides 17 of the sidewalls 18 in the interior 16 of the receiving body 15, in order to be able to introduce a carrier rack (not shown), which can be loaded with glasses to be flushed, into the interior space 16 of the receiving body 15, as is known, for example, in rinsing apparatuses which substantially use water as the rinsing medium. Outlet nozzles 3*a* for the outflow of gas and/or water are arranged on inner sides, preferably on the inner side 20 of a back wall 21 opposite to the flap 14, similarly to the flushing cup 1 shown in FIG. 1, and are correspondingly connected to the associated duct system. In order to insure a uniform outflow onto the inner sides of the vessel, a member 22, rotatably mounted on the floor and preferably like a propeller or fan, with outlet nozzles 3*b* arranged on it, is provided in FIG. 4 by way of example.

In a particularly preferred embodiment, the carrier rack can be constituted to have, connected to the duct system, outlet openings 3*b* on its carrier struts and/or its carrier portions serving to receive drinking vessels. The outlet openings are connected by means of the duct system and the corresponding supply ducts in order to be supplied with a cryotechnical medium. The carrier rack can preferably be constituted as a basket, about such as is used in a dishwasher.

Differing from the embodiment shown in FIG. 1, the rinsing process in the embodiment according to FIG. 4 is not designed for manual force application, but for a selectable rinsing program which can be selected from an operating board (not shown in FIG. 4), as with conventional rinsing apparatuses. Thus, for example, a program can be provided which provides for a short flushing with cryotechnical media, following a conventional hot water rinsing process, in order to make possible an immediate use of the otherwise warmed-tip drinking vessels or even other vessels after they have been cooled.

According to the surrounding conditions which are specific to an application, it is provided that the supply of the gases is carried out in the gaseous or liquid state. A deciding factor for a supply in the liquid state is in particular the provision of the required low temperature and/or sufficient pressure.

Furthermore, besides carbon dioxide, which in particular has been found in practice to be a colorless, odorless and tasteless cryotechnical medium, among other things the use of nitrogen is also particularly provided. However it is conceivable to use other gases for cooling.

The invention furthermore includes embodiments which, according to the field of application, are additionally constituted with a takeoff or suction device for released gas, in order in case of need to exclude in case of need a quality detriment for the user, particularly with frequent use of the flushing apparatus.

The invention is not limited to the described embodiment examples, which can be modified in numerous ways. Thus it is conceivable that only one outlet opening 3*a,* 3*b* is installed on the inner wall 1*b* of the cup 1 and/or in the cavity. According to the invention, outlet openings 3*a,* 3*b* of various geometrical shapes, such as round, angular, or oval, can also be installed.

The outlet openings 3*a,* 3*b* can also be of different sizes; it is understood that their number is increased when smaller outlet openings 3*a,* 3*b* are used, and their number can be reduced with larger outlet openings 3*a,* 3*b*.

The coil 13 of the embodiment shown in FIG. 3 can also be shaped so that the vessels or glasses can be placed upside down over the outside of the coil 13. Here it is understood that the outlet openings 3*b* are also installed on the outer side of the helical walls. Furthermore, the outflow of the cryotechnical gas or water can also be attained by means of a pressure-sensitive release mechanism as described with reference to FIG. 1.

In the embodiment according to FIG. 4, the outlet nozzles can be installed both on the inner side of the floor and/or cover and/or on the inner sides of the sidewalls, and in addition in the carrier rack. They can however also be installed either in the carrier rack or on the inner walls of the receiving body.

The rotary member 22 of the embodiment shown in FIG. 4 can also be embodied as a round rotary member. The rotary member 22 can however also be constituted in another shape. Thus is can be embodied as a spiral, and the outlet openings 3*b* can be installed on the outer surfaces of the spiral arms. However, it is also possible to design the rotary member 22 such that it carries the vessel to be cooled; a raised edge lip can be positioned in order to prevent the glasses slipping off outward.

It is also provided within the scope of the invention to embody the cup according to FIG. 1 with another cross section. Thus an angular, preferably square, cup cross section is also conceivable. It will be understood that the shape of the cup can be adapted to the respective vessel to be cooled. For smaller vessels, the cup can be embodied with a smaller height, and in contrast for elongate vessels, e.g., champagne glasses or bottles, a narrower, higher cup can be chosen. Likewise within the scope of the invention, account can be taken of different sizes of vessels in the manner of installing the outlet nozzles 3*b* on the guide element 4. In the nozzle tree variant according to FIG. 1, the rods 4*b* can then be omitted and the outlet openings 3*b* can also be installed on an envelope of the guide element 4. It is likewise also conceivable to provide rods 4*b* on the coil 13 according to FIG. 3, outlet openings 3*b* then being installed on their outer sides.

It will be understood that the invention includes all these different cup variants, and that the connections and supply leads, in particular for the cryotechnical medium, are formed such that the different cups can be combined together or exchanged for each other.

The flushing apparatus according to the invention can be constituted for the cooling and/or rinsing of vessels of different materials. Thus glasses and also crockery items of porcelain, for example, teacups and/or bottles, can also be rinsed and/or cooled with it.

Finally and in conclusion, it will be understood that the individual features of the invention can also be used in combinations other than those shown and described.

What is claimed is:

1. Flushing apparatus for at least a drinking vessel or a vessel suitable for the storage of liquids, including a space (1*a,* 16) to receive at least one vessel, and a duct system (8) for direct supply of a cryotechnical medium into said space (1*a,* 16)

wherein said space comprises a receiving body (1) surrounding a cavity (1*a*), further comprising a guide element (4) extending axially in the interior of said cavity, an inner wall of at least said receiving body (1) or said guide element (4) having at least respectively one outlet opening (4*b,* 3*a,* 3*b*) and being a portion of said duct system (8).

2. Flushing apparatus according to claim 1, wherein said medium comprises nitrogen.

3. Flushing, apparatus according to claim 1, wherein said medium comprises carbon dioxide.

4. Flushing apparatus according to one of claims 1–3, wherein supply of said medium takes place in at least a gaseous or a liquid state.

5. Flushing apparatus according to claim 1, comprising a control device for defined control of at least pressure, intensity, or temperature of said medium to be supplied.

6. Flushing apparatus according to claim 1, wherein said duct system (8) for supply of said medium has at least one outlet opening (3*a,* 3*b*).

7. Flushing apparatus according to claim 6, wherein said outlet opening is nozzle-shaped.

8. Flushing apparatus according to claim 1, wherein said guide element is in rod form (4) or coil form (13).

9. Flushing apparatus according to claim 8, wherein said guide element (4) includes a pressure-sensitive release device (4*a*) connected to said supply device via a valve.

10. Flushing apparatus according to claim 1, wherein said receiving body (15) has a rotatably mounted rotary member (22) with said outlet openings (3*b*) arranged thereon.

11. Flushing apparatus according to claim 1, wherein a supply system (9) for supply of water is associated with at least an inner wall (1*b*) of said receiving body (1), a guide element (4), or a further guide element which runs in rod form or coil form and is provided with at least one outlet opening (3*b*).

12. Flushing apparatus according to claim 11, further comprising a changeover device for predefined selection of the said duct system (8) for supply of the cryotechnical medium or said water supply system (9).

13. Flushing apparatus according to claim 11, wherein said water supply system (9) and said duct system (8) for supply of the cryotechnical medium have a contacting region.

14. Flushing apparatus according to claim 1, further comprising a heating device associated with at least said duct system (8) or a water supply system (9).

15. Flushing apparatus according to claim 1, further comprising at least a takeoff device or a suction device for released gas.

16. Flushing apparatus for at least a drinking vessel or a vessel suitable for the storage of liquids, including a space (1*a,* 6) to receive at least one vessel, and a duct system (8) for direct supply of a cryotechnical medium into said space (1*a,* 6), wherein said space comprises a closable receiving space (16) for at least said drinking vessel or said vessel suitable for storage of liquid, and outlet openings (3*a,* 3*b*) are arranged on at least inner walls, a ceiling or a floor of said space.

* * * * *